US007017909B1

(12) United States Patent
Awada

(10) Patent No.: US 7,017,909 B1
(45) Date of Patent: Mar. 28, 2006

(54) DRAW POKER

(76) Inventor: Yehia Awada, 4054 S. Industrial Rd., Las Vegas, NV (US) 89103

( * ) Notice: Subject to any disclaimer, the term of this patent is extended or adjusted under 35 U.S.C. 154(b) by 140 days.

(21) Appl. No.: 10/734,975

(22) Filed: Dec. 15, 2003

(51) Int. Cl.
*A63F 1/00* (2006.01)

(52) U.S. Cl. ..... 273/292; 273/274; 463/13; 463/20

(58) Field of Classification Search ..... 273/292, 273/274; 463/13, 20
See application file for complete search history.

(56) References Cited

U.S. PATENT DOCUMENTS 4,651,997 A * 3/1987 Wood ..... 273/274
5,019,973 A * 5/1991 Wilcox et al. ..... 463/13
5,167,413 A * 12/1992 Fulton ..... 463/13
5,944,315 A * 8/1999 Mostashari ..... 273/292
6,098,985 A * 8/2000 Moody ..... 273/292
6,113,103 A * 9/2000 Mostashari ..... 273/292
6,132,311 A * 10/2000 Williams ..... 463/13
6,270,405 B1 * 8/2001 Ferguson ..... 463/13
6,435,509 B1 * 8/2002 Wichinsky et al. ..... 273/292
6,595,520 B1 * 7/2003 Richards et al. ..... 273/292
6,656,044 B1 * 12/2003 Lewis ..... 463/19
6,669,198 B1 * 12/2003 Wichinsky ..... 273/292
6,672,959 B1 * 1/2004 Moody et al. ..... 463/13
6,708,975 B1 * 3/2004 Fox et al. ..... 273/292
6,726,427 B1 * 4/2004 Jarvis et al. ..... 273/292
6,780,104 B1 * 8/2004 Fox ..... 463/13
6,802,773 B1 * 10/2004 Moody ..... 463/13
6,857,957 B1 * 2/2005 Marks et al. ..... 463/13
6,869,074 B1 * 3/2005 Miller ..... 273/292
6,878,060 B1 * 4/2005 Moody ..... 463/13

* cited by examiner

*Primary Examiner*—Eugene Kim
*Assistant Examiner*—D Collins
(74) *Attorney, Agent, or Firm*—Leonard Weiss

(57) ABSTRACT

A video poker machine provides images of five card poker hands. A player may make a draw whereby selected cards of a poker hand are replaced by newly dealt cards thereby forming a second poker hand. The player may make a wager that the first poker hand has a rank greater than a known rank. The player may additionally wager that the rank of the second poker hand is higher than the rank of the first poker hand. A bonus payout may be made based upon the rank of one of the hands.

9 Claims, 2 Drawing Sheets

10

SECOND CHANCE PAY TABLE

12

| | FINAL HAND | PAYOUT |
|---|---|---|
| TWO PAIR | 9 9 2 2 X | 2 : 1 |
| THREE OF A KIND | 9 9 9 X X | 3 : 1 |
| FULL HOUSE | 9 9 9 2 2 | 4 : 1 |
| FOUR OF A KIND | 9 9 9 9 X | 6 : 1 |

14

| | |
|---|---|
| ROYAL FLUSH | 250 : 1 |
| STRAIGHT FLUSH | 50 : 1 |
| FOUR ACES WITH A 2, 3, OR 4 | 400 : 1 |
| FOUR ACES | 160 :1 |
| FOUR OF A KIND, 2, 3, OR 4 | 80 : 1 |
| FOUR OF A KIND, 5-KING | 50 : 1 |
| FULL HOUSE | 9 : 1 |
| FLUSH | 5 : 1 |
| STRAIGHT | 4 : 1 |
| THREE OF A KIND | 3 : 1 |
| TWO PAIR | 1 : 1 |
| JACKS OR BETTER | 1 : 1 |

20

DRAW POKER

FIELD OF INVENTION

This invention is in the general field of casino gaming and, more particularly, is a draw poker game where a pay table is used to determine a payout to a player.

DESCRIPTION OF THE PRIOR ART

Poker is the most frequently played card game in the United States. A player in a Poker game wagers that he holds a Poker hand having a rank that is higher than a rank of a Poker hand held by any other player.

An almost invariant feature of the Poker game is that it is played with a standard deck of fifty two cards and a Poker hand is comprised of five of the cards. Rankings of five card Poker hands, in descending order, are given as:

ROYAL FLUSH, (Ace, King, Queen, Jack and 10 of the same suit);

STRAIGHT FLUSH, (five cards in sequence in any suit, i.e. Jack, 10, 9, 8, 7, of the same suit);

FOUR OF A KIND, (four Aces is highest);

FULL HOUSE, (THREE OF A KIND plus a PAIR, i.e., 10, 10, 10, King King);

FLUSH (Five cards of the same suit);

STRAIGHT (five cards in sequence but of different suits, i.e., (Jack, 10, 9, 8, 7);

THREE OF A KIND (Three cards of the same rank, i.e., three Aces);

TWO PAIRS (i.e., two Kings and two 10's);

ONE PAIR (two 5's); and

NO PAIR

A ranking of cards comprising the five card Poker hand is germane to determining the rank of the poker hand. Thus, for example, the five card Poker hand that is comprised of a pair of 10's has a higher rank than the five card Poker hand that is comprised of a pair of 9's.

In the conventional Poker game, a plurality of players compete against each other, placing bets during the game. When one player has a high ranking hand, such as a royal flush, for example, the one player would like to win as much as possible. The one player correspondingly wagers as much as possible. A likely result of wagering as much as possible is that other players would surrender whereby the one player would win very little. However, when the poker game is structured to make a payout to players in accordance with a pay table, the player with the high ranking hand gets a high payout.

SUMMARY OF THE INVENTION

In a first embodiment of the invention, a Video Poker machine stores a signal representation of one or more standard decks of 52 cards. When a player deposits an amount of a draw poker wager into the machine, face up images of cards of a first Poker hand are provided by the machine. Upon viewing the first Poker hand, the player is provided an option of ending the game by surrendering a part of the draw Poker wager.

The game continues with the player having an option of causing a draw that results in an exchange of images of some of the cards of the first poker hand for images of newly dealt cards, thereby forming a second Poker hand. At any time prior to the draw, the player may make a second chance wager that the rank of the second Poker hand is higher than the rank of the first Poker hand.

A first depression of a draw pushbutton causes a second chance pay table to appear. The player now has a last opportunity to make the second chance wager. A second depression of the draw pushbutton causes the draw. A payout is made to the player in accordance with the second Poker hand and the second chance pay table.

Whether or not the player wins the draw Poker wager is, determined by the second Poker hand and a draw Poker pay table that is posted near the player or otherwise provided to the player.

In a second embodiment of the invention, a Video Poker machine stores signal representations of cards of a plurality standard decks of 52 cards. When the player deposits an amount of a starting wager into the machine, a video image of face up cards of a first initial draw Poker hand, dealt from the first deck of cards, is provided by the machine. At this time the player has an option of ending the game by surrendering a portion of the starting wager.

The player has an option of causing a first draw that results in an exchange of images of some of the cards of the first initial draw Poker hand for images of newly dealt cards from the first deck. A first final hand is formed by the newly dealt cards of the first draw and cards that were not exchanged. When the first final hand meets a minimum payout standard, the player receives a first credit for an amount on the draw Poker pay table that corresponds to the rank of the first final hand and the amount of the starting wager. The game ends when the first final hand does not meet the minimum payout standard.

When the result of the first final hand is the first credit, the machine causes face up images of cards of a second initial hand, dealt from the second deck of cards, to be provided by the machine. At this time, the player has the option of ending the game by surrendering a part of the first credit and receiving a cash payout for the remainder of the first credit.

When the game continues, the player has an option of drawing from the second deck to replace images of some of the cards of the second initial hand with images of newly dealt cards from the second deck, thereby providing the player with cards of a second final hand.

When the second final hand meets the minimum payout standard, the player receives a second credit for an amount on the draw poker pay table that corresponds to the rank of the second final hand for a wager amount equal to the first credit. The game ends when the second final hand does not meet the minimum payout standard. When there is no provision for providing the player with a video image of face up cards of a third initial hand, the player receives a cash payout equal to the second credit.

In a similar manner, this embodiment may include a possibility of serially created additional final hands to provide a winning player with a larger payout.

It should be understood that second chance wagers, such as those used in the first embodiment, may be used in the second embodiment.

Other objects, features, and advantages of the invention should be apparent from the following description of the preferred embodiment thereof as illustrated in the accompanying drawing.

DESCRIPTION OF THE EMBODIMENTS

The present invention is a draw Poker game where a player plays against a host, such as a casino, and most payouts to the player are in accordance with a play table.

In a first embodiment of the invention, a Video Poker machine (not shown) stores a signal representation of one or more standard decks of 52 cards. When the player deposits an amount of an exemplary draw Poker wager of one dollar into the machine, for example, face up images of a five card first Poker hand dealt from one of the decks, referred to as a game deck, is provided by the machine.

The player wins the draw poker wager and a draw poker bonus without making a draw when the first Poker hand has a rank of a straight or higher. Correspondingly, when the player makes a second chance wager (which is explained hereinafter) prior to cards being dealt and the first Poker hand has the rank of a straight or higher, the player wins the second chance wager and a second chance bonus without making a draw.

Figure 1:
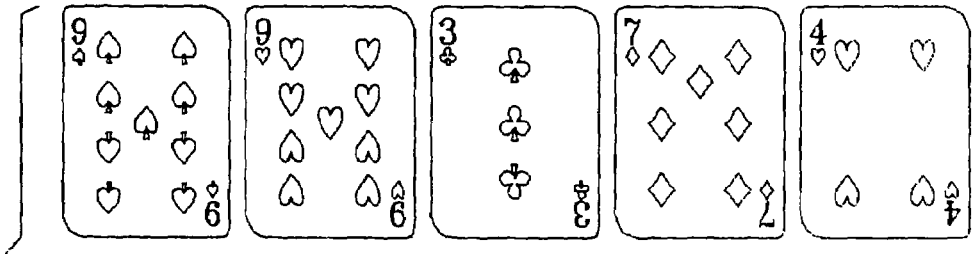
FIG. 1 is a plan view of cards of a first Poker hand and a view of a Second Chance Pay Table in accordance with a first embodiment of the invention.

As shown in FIG. 1, a first Poker hand 10 includes a 9♠, 9♡, 3♣, 7♢ and a 4♡ whereby the first Poker hand 10 has a rank of a pair of nines.

Upon viewing the first Poker hand 10, the player has an option of surrendering by depressing a surrender pushbutton on the machine. When the player surrenders, the machine disgorges the game deck that exchanges some of the images of cards of the first Poker hand 10 for images of newly dealt cards to form a second Poker hand. The player wins the second chance wager when the second poker hand has a higher rank than the first poker hand. The player wins the draw poker wager when the second draw poker hand is Jacks or better.

The machine includes five hold/exchange pushbuttons corresponding to images of the cards 9♠, 9♡, 3♣, 7♢ and 4♡, respectively and an exchange pushbutton. The player makes a depression of the pushbuttons corresponding to the cards 3♣, 7♢ and 4♡. Thereafter, the player makes a first depression of the exchange pushbutton to indicate that the player wants to exchange the 3♣, 7♢ and 4♡ of the Poker hand 10 for newly dealt cards from the game deck to form the second Poker hand. In response to a first depression of the exchange pushbutton, a video image of a second chance pay table 12 appears whereby the player can evaluate prospective risks and rewards of the second chance wager. The player may make the second chance wager after the first depression of the exchange pushbutton but before a second depression of the exchange pushbutton.

It should be understood that the video image of the second chance pay table 12 is generated by the machine after the player indicates cards that are to be retained. Therefore, the machine has a capability of generating a multiplicity of video images of second chance pay tables. According to the Second Chance Pay Table 12, the second Poker hand has a minimum rank of two pairs, 9's and 2's, for a Second Chance Payout.

Figure 2:
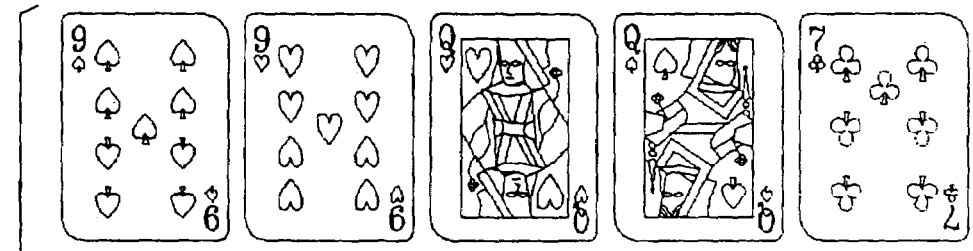
FIG. 2 is a plan view of cards of a second Poker hand and a view of a draw Poker pay table in accordance with the first embodiment.

As shown in FIG. 2, in response to the second depression of the draw pushbutton, the 3♣, 7♢ and 4♡ are exchanged for a Q♠, Q♡ and 7♣ thereby forming the second Poker hand 14. Accordingly, a second Poker hand 14 is comprised of two pairs, 9's and queens.

As shown in FIG. 2, a Draw Poker Pay Table 20 and the Second Poker Hand 12 appear concurrently in response to the player making the second depression of the draw pushbutton. According to the Pay Tables 20, 14, the two pairs (9's and queens) causes the player to win a 1 for 1 Draw Poker Payout and a 2 for 1 Second Chance Payout.

According to a second embodiment of the invention, a Video Poker machine stores signal representations of three standard decks of 52 cards. Additionally, the standard draw poker payout table (FIG. 2) is either posted proximal to the machine or made otherwise available.

When the player deposits an amount of a starting wager into the machine, a video image of a first draw Poker hand, dealt from the first deck, is randomly provided by the machine. The player may cause a first draw where designated cards of the first draw Poker hand are exchanged for newly dealt cards from the first deck in an effort to provide a first final hand with a rank that is higher than the rank of the first draw Poker hand. Prior to the first draw, the player has an option of depressing a surrender pushbutton to cause an end to the game and a surrender of a portion of the starting wager. The player receives a payout of a remaining portion of the starting wager.

Figure 3:
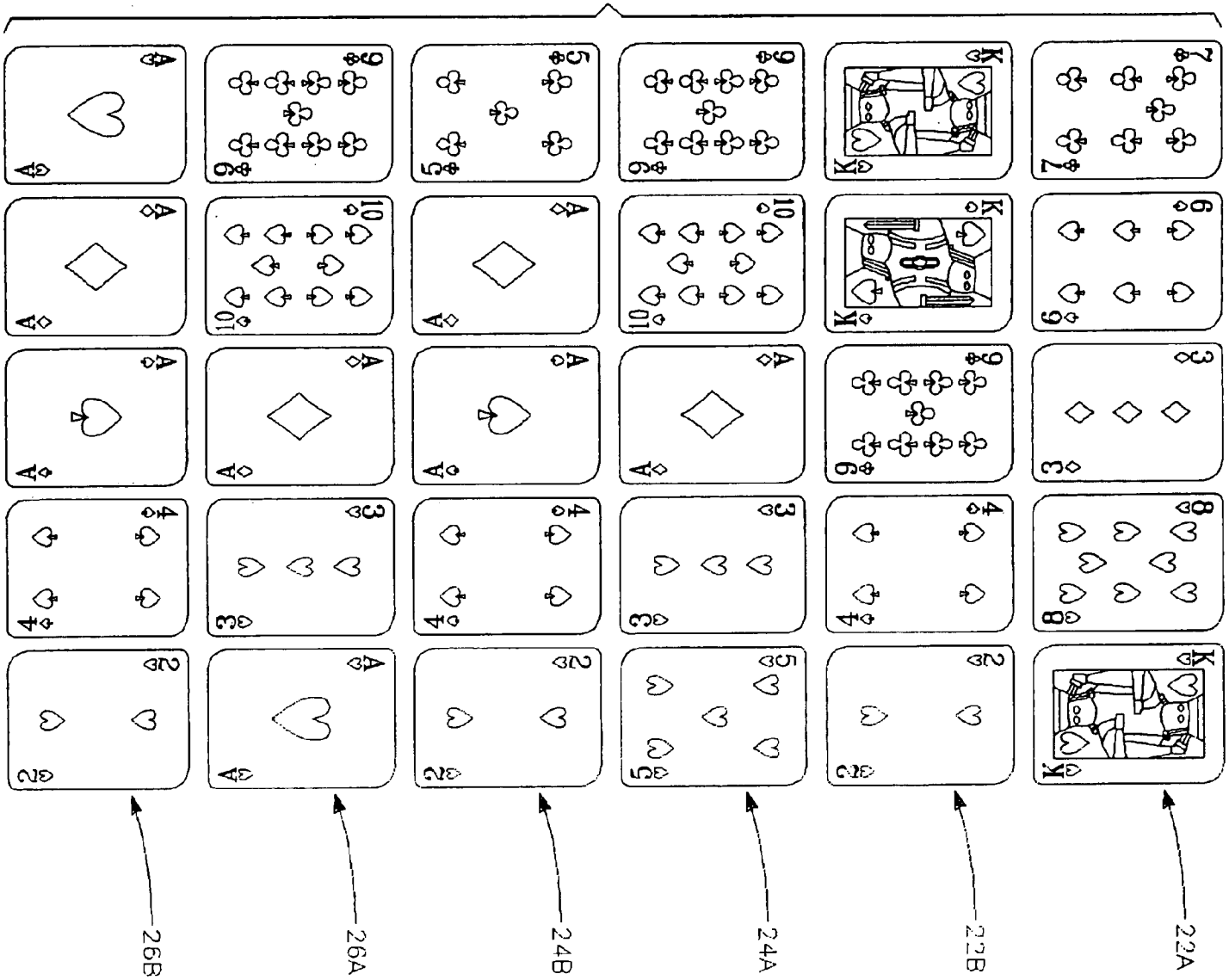
FIG. 3 is a plan view of Poker hands in accordance with a second embodiment of the invention.

As shown in FIG. 3, a first draw poker hand 22A includes the 7♣, 6♠, 3♢, 8♡ and K♡. The player depresses pushbuttons on the machine to indicate a desire to exchange the 7♣, 6♠, 3♢, 8♡ for newly dealt cards while retaining the K♡.

In response to a depression of the draw pushbutton a final first poker hand 24 is produced. The final first poker hand 22B includes the K♡, K♠, 9♣, 4♠, 2♡. According to the draw poker payout table (FIG. 2) the final first poker hand is valued at a 1 for 1 payout. Accordingly, the player receives a first credit for the 1 for 1 payout. It should be understood that if the rank of the final first poker hand was lower than a pair of jacks, the player would receive no payout and the game would be at an end.

When the game continues, a video image of a second draw Poker hand, dealt from the second deck, is randomly provided by the machine. The player may cause a second draw where designated cards of the second draw Poker hand are exchanged for newly dealt cards from the second deck in an effort to provide a second final second Poker hand with a rank that is higher than the rank of the second draw Poker hand. Prior to the second draw, the player has an option of depressing a surrender pushbutton to cause an end to the game and a surrender of a portion of the first credit. The player receives a cash payout equal to a remainder of the first credit.

A second draw poker hand 24A includes the 9♣, 10♠, A♢, 3♡ and A♡. The player depresses pushbuttons on the machine to indicate a desire to exchange the 9♣, 10♠, 3♡ for newly dealt cards while retaining the A♡, A♢.

In response to a depression of the draw pushbutton, a final second Poker hand 24B is produced. The final second poker hand 24B includes the A♡, A♢, A♠, 4♠, 2♡. According to the draw poker payout table (FIG. 2) the final first Poker hand is valued at a 3 for 1 payout. Accordingly, the player receives a second credit for the 3 for 1 payout for an amount wagered equal to the first credit. It should be understood that if the rank of the final second Poker hand 24 was lower than a pair of jacks, the player would receive no payout and the game would be at an end.

When the game continues, a video image of a third draw Poker hand, dealt from the third deck, is randomly provided by the machine. The player may cause a third draw where designated cards of the third draw Poker hand are exchanged for newly dealt cards from the third deck in an effort to provide a third final hand with a rank that is higher than the rank of the third draw Poker hand. Prior to the third draw, the player has an option of depressing a surrender pushbutton to cause an end to the game and a surrender of a portion of the second credit.

A third draw Poker hand 26A includes the 9♧, 10♤, A♢, 3♡ and A♡. The player depresses pushbuttons on the machine to indicate a desire to exchange the 9♧, 10♤, 3♡ for newly dealt cards while retaining the A♡, A♢.

In response to a depression of the draw pushbutton a final third Poker hand 28 is produced. The final third Poker hand 26B includes the A♡, A♢, A♤, 4♤, 2♡, for three if a kind. According to the draw poker payout table (FIG. 2) the final third poker hand is valued at a 3 for 1 payout. Accordingly, the player receives a 3 for 1 payout for an amount wagered equal to the second credit and the game is at an end.

It should be understood that if the rank of the final third Poker hand was lower than a pair of jacks, the player would receive no payout and the game would be at an end.

In this embodiment, the player must win three consecutive rounds of draw poker before receiving a payout. Because the player must win three consecutive rounds, a three round completion payout is given the player in addition to the 3 for 1 payout for an amount wagered equal to the second credit.

It should be understood that games described herein can be played with decks of cards that include wild cards and jokers.

While the invention has been particularly shown and described with references to embodiments thereof, it should be understood by those skilled in the art that changes [n fprm and detail may be made therein without departing from the spirit and scope of the invention.

I claim:

1. In a method of a playing a game on a gaming machine, the steps of:

providing a video image of five cards randomly dealt from a standard deck of fifty two cards in response to a player depositing a draw Poker wager into the machine, said five randomly dealt cards forming a first Poker hand;

providing a video image of a second chance pay table;

permitting said player to deposit a second chance wager into the machine prior to said player making a draw that causes an exchange of images of selected ones of said five cards with images of newly dealt cards from said deck thereby forming a second Poker hand;

permitting said player to make said draw;

providing a view of a draw poker pay table;

making a payout to said player in accordance with said second Poker hand and the draw Poker pay table; and making a payout to said player in accordance with said second Poker hand and a second chance pay table when said player makes said second chance wager.

2. In the method of playing the game of claim 1, upon viewing the first Poker hand, the step of providing said player an option of ending the game by surrendering a part of said draw Poker wager.

3. In the method of claim 1 wherein said step of providing said video image of said second chance pay table includes the steps of:

said player providing to the machine a first exchange input that indicates which cards of said first poker hand are to be exchanged;

providing said video image of said second chance table in response to said exchange input; and providing a video image of a second poker hand in response to a second exchange input.

4. In the method of claim 1, the additional step of making a draw poker bonus payout when the first poker hand has a rank that is a straight or higher.

5. In the method of claim 1, the additional step of making a second chance bonus payout when the second hand wager is made prior to cards being dealt and the first poker hand has a rank that is a straight or higher.

6. In the method of playing a game on a gaming machine, the steps of:

providing a video image of five cards randomly dealt from a first standard deck of fifty two cards in response to a player depositing a starting wager into the machine, said five randomly dealt cards forming a first Poker hand;

permitting said player to make a draw that causes an exchange of images of selected cards of said first Poker hand with images of newly dealt cards from said first deck thereby forming a first final hand;

providing a view of a draw poker pay table;

giving said player a first credit in accordance with said draw Poker pay table for an amount wagered equal to the starting wager, the rank being that of the first final hand;

providing a video image of five cards randomly dealt from a second standard deck, thereby forming a second Poker hand;

permitting said player to form a second final hand by making a draw that exchanges images of selected cards of said second Poker hand for images of newly dealt cards from said second deck;

giving said player a final payout in accordance with said pay table for an amount wagered equal to said first credit and the rank of the second final hand; and ending said game when any final hand does not meet a minimum payout standard of said pay table.

7. In the method of claim 6 wherein said player has an option of ending the game upon viewing said first draw Poker hand by surrendering a part of the starting wager.

8. In the method of claim 6 wherein said player has an option of ending the game upon viewing said second draw Poker hand by surrendering a part of the first credit.

9. In the method of claim 6 wherein said player is given a completion payout concurrently with said final payout.

* * * * *

US007017909C1

(12) EX PARTE REEXAMINATION CERTIFICATE (6607th)

United States Patent

Awada

(10) Number: US 7,017,909 C1

(45) Certificate Issued: Jan. 6, 2009

(54) DRAW POKER

(75) Inventor: Yehia Awada, Las Vegas, NV (US)

(73) Assignee: Tyche Entertainment, Inc., Las Vegas, NV (US)

Reexamination Request:
No. 90/008,559, Mar. 27, 2007

Reexamination Certificate for:

| | |
|---|---|
| Patent No.: | **7,017,909** |
| Issued: | **Mar. 28, 2006** |
| Appl. No.: | **10/734,975** |
| Filed: | **Dec. 15, 2003** |

(51) Int. Cl.
*A63F 1/00* (2006.01)

(52) U.S. Cl. ..... 273/292; 273/274; 463/13; 463/20

(58) Field of Classification Search ..... None

See application file for complete search history.

(56) References Cited

U.S. PATENT DOCUMENTS

| | | | |
|---|---|---|---|
| 5,882,259 | A | 3/1999 | Holmes |
| 6,419,578 | B1 | 7/2002 | Moody |
| 2005/0059452 | A1 | 3/2005 | Hartl |
| 2005/0085285 | A1 | 4/2005 | Muskin |

OTHER PUBLICATIONS

Shackleford, "Video Poker Appendix 2," indexed on Wayback Machine (www.archive.org) on Oct. 1, 2002, http://web.archive.org/web/20021001145808/www.thewizardofodds.com/game/vidpokapx2.html.

*Primary Examiner*—Jeffrey Jastrzab

(57) ABSTRACT

A video poker machine provides images of five card poker hands. A player may make a draw whereby selected cards of a poker hand are replaced by newly dealt cards thereby forming a second poker hand. The player may make a wager that the first poker hand has a rank greater than a known rank. The player may additionally wager that the rank of the second poker hand is higher than the rank of the first poker hand. A bonus payout may be made based upon the rank of one of the hands.

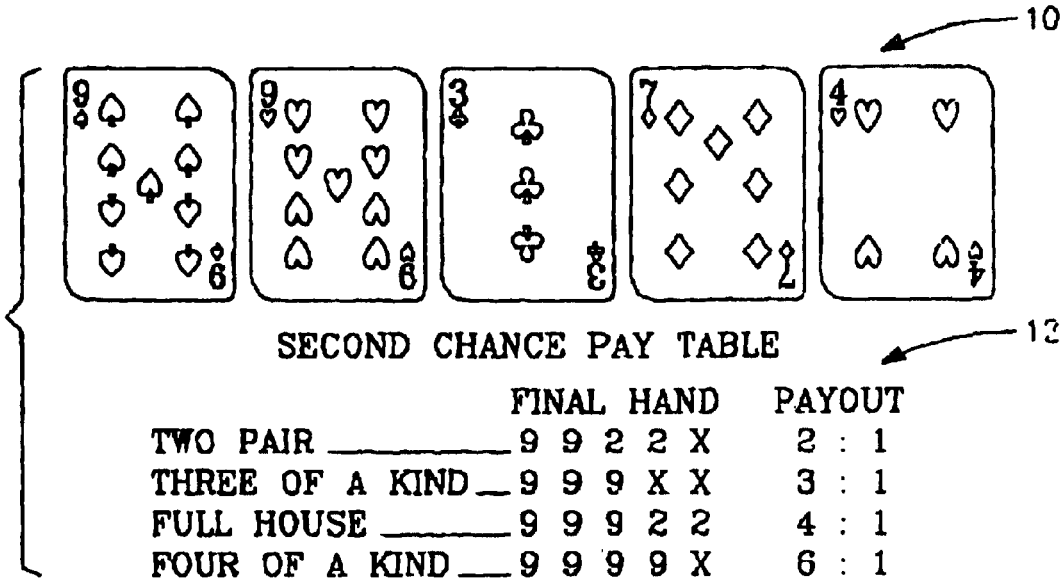

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–5 are cancelled.

Claims 6–9 were not reexamined.

* * * * *